US011505947B2

(12) United States Patent
Ghirardi

(10) Patent No.: US 11,505,947 B2
(45) Date of Patent: Nov. 22, 2022

(54) METHOD FOR COVERING BUILDING WALLS AND STRUCTURE FOR SUPPORTING WALL COVERS

(71) Applicant: Marmi Ghirardi S.r.l., Carpenedolo (IT)

(72) Inventor: Daniele Ghirardi, Carpenedolo (IT)

(73) Assignee: MARMI GHIRARDI S.R.L, Carpenedolo (IT)

( * ) Notice: Subject to any disclaimer, the term of this patent is extended or adjusted under 35 U.S.C. 154(b) by 143 days.

(21) Appl. No.: 16/472,907

(22) PCT Filed: Nov. 22, 2017

(86) PCT No.: PCT/IB2017/057331

§ 371 (c)(1),
(2) Date: Jun. 24, 2019

(87) PCT Pub. No.: WO2018/116030

PCT Pub. Date: Jun. 28, 2018

(65) Prior Publication Data

US 2019/0345722 A1 Nov. 14, 2019

(30) Foreign Application Priority Data

Dec. 23, 2016 (IT) ..... 102016000130648

(51) Int. Cl.
*E04F 13/08* (2006.01)
*E04F 13/00* (2006.01)
*E04F 13/12* (2006.01)

(52) U.S. Cl.
CPC ..... *E04F 13/0862* (2013.01); *E04F 13/007* (2013.01); *E04F 13/0885* (2013.01); *E04F 13/12* (2013.01)

(58) Field of Classification Search
CPC ..... E04F 13/12; E04F 13/123; E04F 13/14; E04F 13/0862; E04F 13/007; E04F 13/0885

(Continued)

(56) References Cited

U.S. PATENT DOCUMENTS 3,388,515 A * 6/1968 Gruettner ..... E04B 9/00 52/518
5,632,125 A * 5/1997 Osanai ..... E04B 2/96 52/774

(Continued)

FOREIGN PATENT DOCUMENTS

DE 9002601 U1 5/1990
EP 3073025 A2 9/2016
GB 2312223 A 10/1997

*Primary Examiner* — Paola Agudelo
*Assistant Examiner* — Adam G Barlow
(74) *Attorney, Agent, or Firm* — Volpe Koenig

(57) ABSTRACT

A method and a structure are described that allow covers to be simply and quickly applied to building walls and façades, regardless of whether the walls are inside or outside, flat or curved, ventilated or not. First, the method provides for making a bearing surface, parallel to the wall, by using flexible panels, then constraining the bearing surface to the wall by fastening elements whose orientation can be adjusted, next precisely adjusting the orientation of the bearing surface from the wall by acting selectively on the single fastening elements, and finally fastening the cover, for example marble slabs, to the bearing surface. The support structure includes the just described elements.

11 Claims, 4 Drawing Sheets

(58) Field of Classification Search
USPC ..... 52/235, 238.1, 483.1, 489.1, 506.06
See application file for complete search history.

(56) References Cited

U.S. PATENT DOCUMENTS

| | | | | | |
|---|---|---|---|---|---|
| 5,732,520 | A * | 3/1998 | Maietta | E04F 13/00 | 52/745.1 |
| 5,836,117 | A * | 11/1998 | Johnson | E04B 1/0046 | 52/204.5 |
| 8,336,273 | B2 | 12/2012 | Enns | | |
| 9,309,677 | B1 * | 4/2016 | Anic | E04F 13/0864 | |
| 2011/0023398 | A1 * | 2/2011 | Ismay | E04F 13/0871 | 52/483.1 |
| 2016/0040425 | A1 * | 2/2016 | Farahmandpour | E04F 13/0853 | 52/235 |

* cited by examiner

METHOD FOR COVERING BUILDING WALLS AND STRUCTURE FOR SUPPORTING WALL COVERS

FIELD OF THE INVENTION

The present invention refers to a method for covering building walls with slabs or tiles, and to a structure for supporting wall covers. In particular, the present invention refers to a method for making walls and ventilated façades covered by stone materials.

STATE OF THE ART

In buildings it is known to cover building walls with covers in the form of slabs, tiles or the like, in order to make the building aesthetically pleasing. Commonly used materials are stone, for example marble and granite, reconstituted stones, glass, aggregates, wood, ceramic materials, etc.

Covers are applied both to inside walls of the building and to outside ones, for example on façades. Systems commonly used for fastening covers are different in the two cases.

In fact, inside the buildings small tiles or wall fittings are mainly used, having non-critical weight and, for this reason, able to be laid by a person without the aid of machinery. Generally, the fastening is obtained by chemical adhesives (continuous type fastening).

On the contrary, on outside walls of buildings and in particular on façades, large slabs, very heavy compared to the previous example, are preferred so that the application nearly always requires them to be lifted by mechanical means. The fastening is obtained mainly through mechanical systems, for example expansion bolts or clamps (point fastening), possibly supported by chemical adhesives (hybrid fastening).

Another important factor is represented by climatic conditions. Inside the buildings the covers are protected from atmospheric agents and rapid temperature changes, whereas outside the fastening system selected to support the covers is required to resist water, humidity and, in general, unfavorable climatic conditions, such as saltiness in the air or temperature changes. For example, mechanical fastening systems can undergo oxidation processes activated by humidity or rainfall, or else strong solar radiation can cause them to expand, thereby resulting in cracks in the cover, etc.

Sometimes, for aesthetic choice, building walls and façades are not flat but rounded, wavy or curved. In this case, the cover application is even more complex because flat slabs have to be fastened to a curved surface. In these cases, chemical adhesives are often used together with mechanical fastening systems.

As it can be understood, there are several technical difficulties, not limited to the examples just described.

As regards cover application, among the most difficult cases from the technical point of view, ventilated walls and façades, especially the curved ones, can be included. A ventilated wall/façade is characterized by the fact that the cover is not adherent to the wall/façade itself, but is spaced out in order to define an interstice which facilitates the natural circulation of the air due to the convective motion caused by openings at the base and top of the wall/façade.

The documents U.S. Pat. No. 8,336,273 and GB 2312223 describe corresponding structures for supporting covering slabs on ventilated walls. The structures comprise typical carpentry elements: section bars and rails having the function of uprights and crossbeams, as well as brackets and screws which together define a rigid and fixed framework.

The solutions adopted so far for applying the covers have some limitations or drawbacks, which are particularly evident in case of application on wavy or curved ventilated walls/façades.

First of all, the supporting structure must be raised and anchored to the wall, taking care that the pitch between the uprights of the structure is compatible with the width of the slabs used for the cover, so that each slab can actually be fixed at the corners or edges. In most cases, also the pitch between the crosspieces must be absolutely compatible with the height of the covering slabs, for the same reasons. Therefore, the number of elements making up the supporting structure is usually high. Application takes long time and mistakes are very likely to be made.

Another drawback is given by the fact that the supporting structure, in practice consisting of uprights and crossbeams, does not allow the use of chemical adhesives on the entire rear surface of the covering slabs but only at the edges, where uprights and crossbeams are.

Moreover, if the wall/façade is wavy or curved, the supporting structure is particularly complex to be raised because workers must also be careful that the uprights and crosspieces extend with the correct radius of curvature. Sometimes the section bars are required to be curved on the building site, during application, thus proceeding by trial and error.

DE 9002601U1 describes a system for making ventilated walls with extensible supporting elements, i.e. whose length can be adjusted, in order to increase or decrease the width of the interstice between the masonry wall of the building and the additional wall erected to support the cover.

SUMMARY OF THE INVENTION

Object of the present invention is therefore to provide a solution better than those currently available, in particular a method and a structure which allow covers to be more simply and quickly applied to walls and façades.

Therefore, in a first aspect, the present invention concerns the method according to claim 1 of covering a building wall which is either inside or outside, flat or curved, ventilated or not.

In particular, the method provides for:

a) making a bearing surface parallel to the wall by using flexible panels;

b) constraining the bearing surface to the wall by fastening elements whose orientation can be adjusted;

c) precisely adjusting the orientation of the bearing surface from the wall by acting selectively on the single fastening elements, and d) fastening the cover, e.g. marble slabs, to the bearing surface.

The combined use of flexible panels and fastening elements, whose orientation can be adjusted, allows the application of the cover to be simplified and sped up, especially in cases where the desired aesthetic effect is provided by a curved or wavy cover. In fact, the flexible panels, which can be easily handled by the workers on the building site, together define the bearing surface which, in turn, extends in the space with a pattern that can be shaped to different three-dimensional shapes, by acting on the adjustable fastening elements.

In other words, the bearing surface, which is preferably continuous, behaves as a skin on which the cover is actually applied (instead of directly on the wall or on a fixed framework).

The bearing surface can be shaped so as to remain flat, or curved or wavy in one or more directions (vertical, horizontal, oblique). The three-dimensional pattern of the bearing surface can be modified by the workers during the application; when the desired shape is obtained, the workers lock the fasteners to make this shape permanent.

In practice, each fastening element acts as orientable and, preferably, translatable anchoring point. Being flexible, the panels can be curved to adapt themselves to the adjustments of each fastening element. Therefore, by suitably adjusting each fastening element during application, the desired bearing surface is quickly and easily obtained in terms of distance from the wall and curvature, or curvatures.

On the other hand, with the solutions of the known art, each anchoring point of the cover must be arranged in advance on the building site, and no adjustments such as those described above are provided.

Preferably steps a) and b) are carried out simultaneously, as the flexible panels are constrained to the wall and, if necessary, to one another.

The panel can be curved before step a) and/or during step c), either manually by workers or through appropriate machinery, even before being transported to the building site.

Preferably, also the extent of the fastening elements can be adjusted. This allows step c) to be carried out by precisely adjusting also the distance of the bearing surface from the wall, by selectively acting on the single fastening elements. In other words, the distance of the bearing surface from the wall can be changed by acting on the fastening elements. This can be useful for creating an interstice and making the wall, or façade, ventilated.

The cover, for example slabs of stone, glass, ceramic, aggregate materials, etc., can be fixed to the bearing surface by mechanical anchors and/or chemical adhesives.

It is not necessary for each covering element, for example each slab, to match a single elastic panel. In general, configurations in which covering elements are less, or more, extended than a single elastic panel are possible.

The method according to the present invention can also be carried out by providing a framework, for example a metal lattice made of steel beams, fastened to the wall. The frame can be used to modify the volumes at the wall. In this case the flexible panels are constrained to the framework by means of fastening elements, and not directly to the wall.

A second aspect of the present invention relates to the supporting structure of wall coverings of buildings, according to claim 12.

The structure comprises a plurality of fastening elements that can be constrained to a wall or framework connected to a wall, and a plurality of flexible panels that can be constrained to the fastening elements. The assembly of flexible panels constrained to the fastening elements defines a bearing surface on which the cover, for example tiles or concrete slabs, can be applied. The fastening elements can be selectively oriented to locally adjust the orientation of the bearing surface with respect to the wall. In this way the bearing surface can be kept flat, or curved or wavy in at least one direction.

Preferably, the fastening elements can also be selectively extended to locally adjust the distance of the bearing surface with respect to the wall.

Preferably, the flexible panels are selected among sheet metals, metal meshes and multilayer panels.

Preferably, the surface of the flexible panels intended to support the cover is smooth, or corrugated, perforated, bossy or with rough surface finishing that aids the adhesion of chemical adhesives.

As mentioned above, preferably the flexible panels can be manually curved without any machinery aids, so that they can be easily and quickly curved by the operators during the application. However, there is always the possibility of using machinery in order to bend the panels with small radii of curvature that cannot be obtained manually.

Preferably, the flexible panels are resistant against atmospheric agents, for example they are made of a metal not subject to oxidation, or else they are painted or zinc-plated.

If necessary, the flexible panels are coupled to thermally insulating materials, for example at the face which is opposite the wall. If necessary, the flexible panels are covered by films that intercept ultraviolet rays, or by films that shield radio signals and mobile-telephone networks.

In the preferred embodiment, fastening elements comprise:

a spacer permanently fastenable to the wall, e.g. through plugs, or to a framework jutting from the wall and cantileverly protruding, and an orientable element translatable along the spacer and rotatable with respect thereto during the adjustment, and fastenable to the spacer itself in a permanent position. The flexible panels can be fastened to the orientable element.

BRIEF LIST OF THE FIGURES

Further characteristics and advantages of the invention will be more evident by the review of the following specification of a preferred, but not exclusive, embodiment, which is depicted for illustration purposes only and without limitation, with the aid of the attached drawings, in which.

DETAILED DESCRIPTION OF THE INVENTION

FIGS. 1-4 schematically show how a ventilated façade can be made by exploiting the teachings of the present invention.

Figure 1:
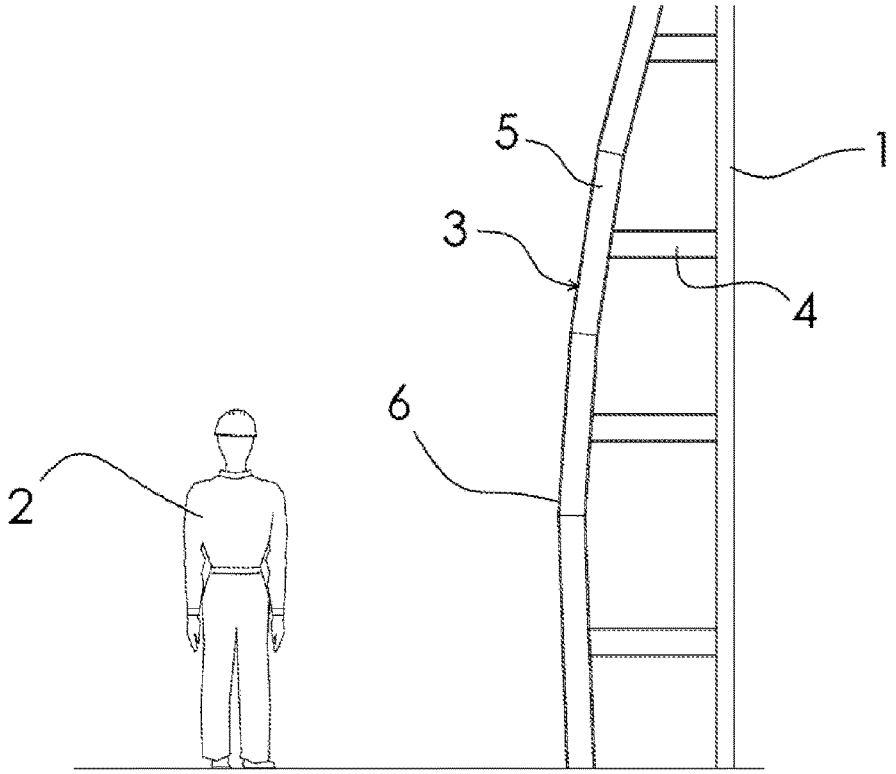
FIG. 1 is a schematic elevation view of a ventilated façade obtained with the method and structure according to the present invention, at the beginning of its application.

FIG. 1 shows the outer wall 1 of a building and an operator 2 standing outside the building. The wall 1 can be of various kinds: made of reinforced concrete, prefab, made of bricks, etc. The wall 1 is outwardly equipped with a base framework 3, which can also be defined as a sub-frame, and anchored to the wall itself. The framework 3, which is generally optional, is obtained by assembling metal sections 4, 5, for example of steel or aluminum, by means of screws, bolts, welding or other traditional means used in carpentry.

In the example shown in the figures, the framework 3 comprises crossbeams 4 and uprights 5—in practice T-beams or double-T-beams, fastened to each other so as to define a curved profile 6 to be covered with covering slabs. In fact, it can be noted that the uprights 5 are not vertical. If required, the framework 3 may also include bracing.

The following refers to the example shown in the figures, in which the profile 6 is curved in the vertical direction; clearly the present invention also applies to the case in which the curvature is in horizontal direction, or even in oblique direction.

Figure 2:
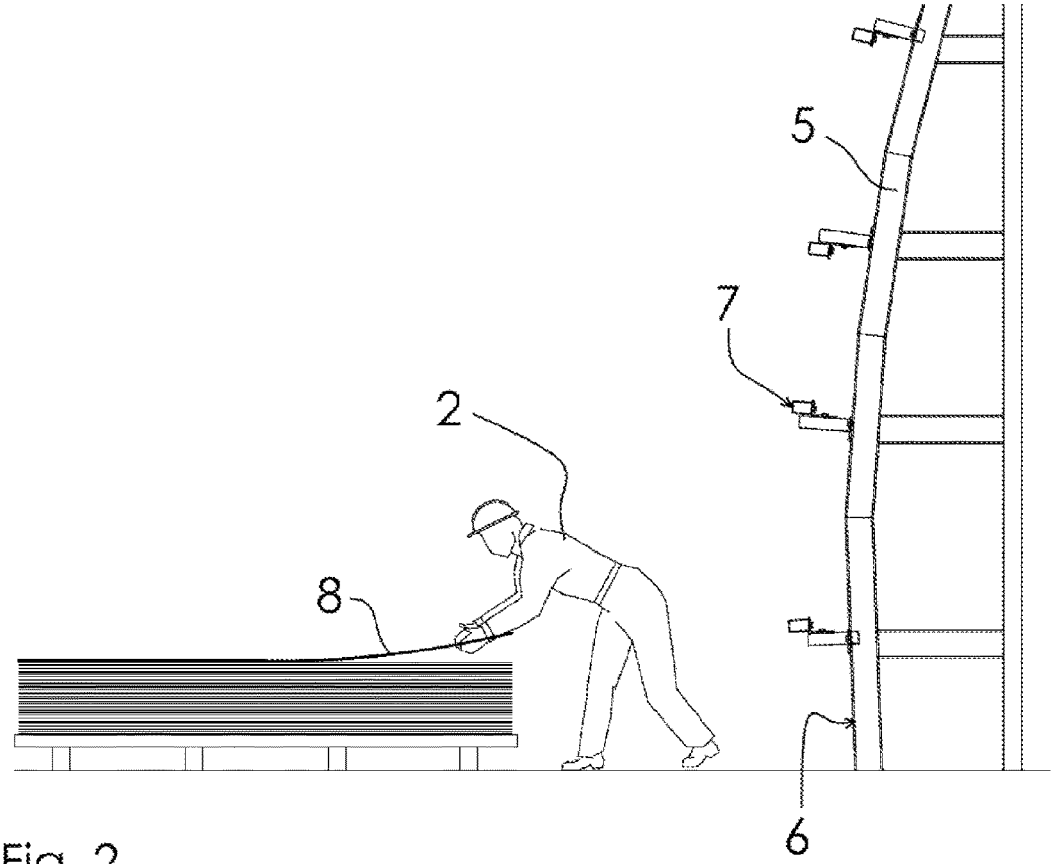
FIG. 2 is a schematic elevation view of the ventilated façade shown in FIG. 1, at a later stage of the application.

FIG. 2 shows a later moment in which the framework 3 has been equipped with a plurality of fastening elements 7 which form part of the supporting structure according to the present invention and which will be described in greater detail hereafter. The fastening elements 7 are orientable and preferably also extensible, as in the example shown in the figures. In the example shown, the fastening elements 7 provide an anchoring point at a given distance from the wall 1 and the uprights 5, precisely for the purpose of defining the interstice 10 provided for ventilated façades.

The operator 2 then fastens the panels 8 exactly to the fastening elements 6.

Figure 3:
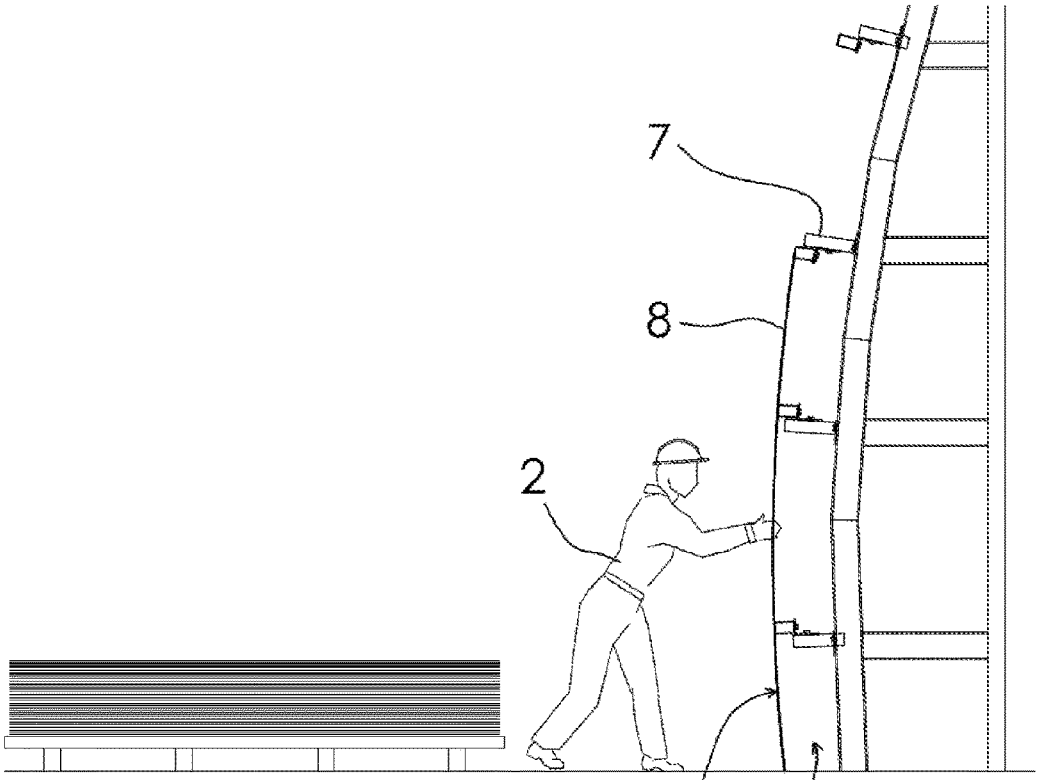
FIG. 3 is a schematic elevation view of the ventilated façade shown in FIG. 1, at a third stage of the application.

FIG. 3 shows the operator 2 while fastening the panels 8 to the fastening elements 7.

As can be seen, the panels 8 are flexible to suit the curvature of the profile 6, i.e. to take the desired curvature, namely the curvature the ventilated façade should exhibit.

It is therefore necessary to clarify that the panels 8 can be made in various ways, as long as they are flexible. For example, the panels 8 can be made:

- of sheet metal, either smooth or corrugated or else with a surface finishing aiding the adhesion of chemical adhesives;
- of metal mesh or perforated metal sheet;
- as multi-layer panels, sandwich coupled to one another, for example honeycomb metal panels immersed in an insulating resin.

The panels 8 are preferably made of an oxidation-resistant material, or are treated or painted in order to achieve this result.

The thickness of the panels 8 may be few millimeters, as long as it allows deflection and any definitive bending of the panels 8, without failures.

The salient characteristic of the panels 8 is flexibility. In fact, the operator 2 must be able to easily fasten the panels 8 to the fastening elements 7, preferably without the aid of particular machinery or tools. For example, FIG. 3 shows the operator 2 which manually bends a panel 8 by constraining it to the fastening elements 7. However, if small radii of curvature have to be obtained, the panels 8 must be able to be pre-curved, for example in laboratory by using special machinery, before the transport to the building site and the relative application.

The constraint between the flexible panels 8 and the fastening elements 7 can be obtained by nails, rivets, welding (for metal panels), screws or other equivalent means.

The panels 8 may also be constrained to each other in order to strengthen the application, if necessary.

Preferably, not only the extent of the fastening elements 7 can be adjusted, i.e. the latter allow the distance of the corresponding panels 8 from the wall 1 to be modified within a certain limit, but also their orientation, i.e. they allow the flexible panels 8 to be kept tilted with respect to the wall 1, as will be described below.

Figure 4:
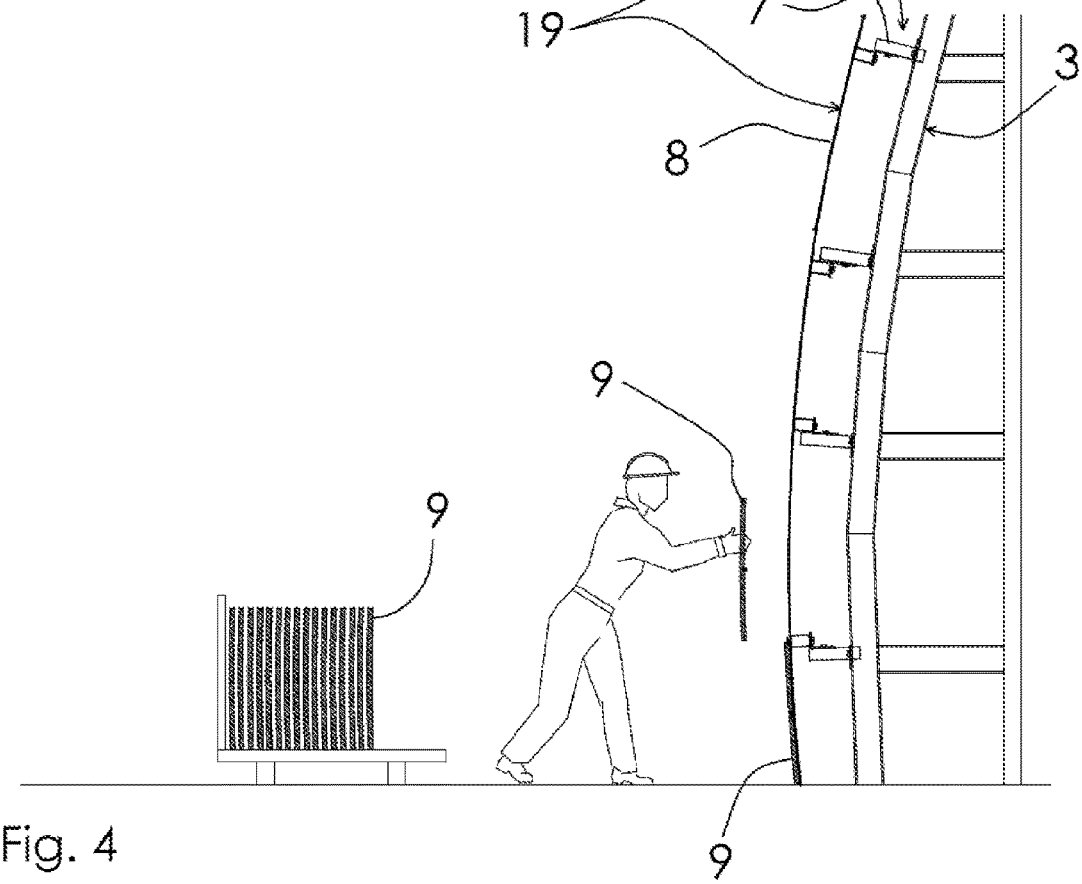
FIG. 4 is a schematic elevation view of the ventilated façade shown in FIG. 1, at a fourth stage of the application.

FIG. 4 shows a further successive moment in which all the panels 8 have been correctly fastened to the framework 3, with the due curvature. The operator 2 works for fastening covering slabs 9 on the panels 8 at the surface facing outwards. When the façade is finished, the covering slabs 9 will remain visible to those observing the building from the outside.

The covering slabs 9 may be made of stone, wood, glass, ceramics, aggregates of different materials, etc.

The covering slabs 9 can be fastened to the respective panel 8 by mechanical fasteners or chemical adhesives or both of them.

If an adhesive substance is used, the relative type is selected based on the type of covering, the thickness of the adhesive, the type of panels 8 used, and the elasticity of the building.

Preferably, the flexible panels 8 are larger than a covering slab 9, that is to say that a plurality of covering slabs 9 can be anchored on a single panel 8. But not necessarily it is the only possibility.

Basically, the bearing surface 19 defined by the panels 8 constitutes a sort of skin having the façade cover anchored thereto. Basically, a continuous bearing surface 19 (with the exception of any small interruptions), flat or curved, is created with the panels 8 and then is covered.

The proposed solution offers several advantages: the panels 8 are light, easy to handle and can be curved only by hands, and the curvature can be adjusted even after the panels 8 have been constrained to the fastening elements 7.

The framework 3, if any, can therefore be quickly made, without necessarily pursuing the maximum precision in positioning its components 4 and 5, and with not-close tolerances. It is not only the framework 3 that defines the curvature of the façade, but most of all the bearing surface 19 defined by the panels 8, which allows the desired curvature to be obtained in all the areas of the façade, point by point, and in the three dimensions.

In addition, if the covering slabs 9 have to be fastened by using chemical adhesives, the panels 8 provide a large adhesion surface.

Another advantage is that the panels 8 of one or more insulating layers can be provided on the side facing the interstice 10. For example, a layer made of insulating material can be glued or otherwise fastened to the panels 8 before being transported to the building site.

In the case of unventilated walls or façades, the interstice 10 can be filled with insulating materials, for example with granulated cork. In fact the panels 8 on one side, and the wall 1 on the other side, would effectively contain the granulate.

Clearly if the present invention is used for covering unventilated walls, for example internal walls, the framework 3 may also not be present: as a matter of fact, the fastening elements 7 can be directly fastened to the wall 1.

Figure 5:
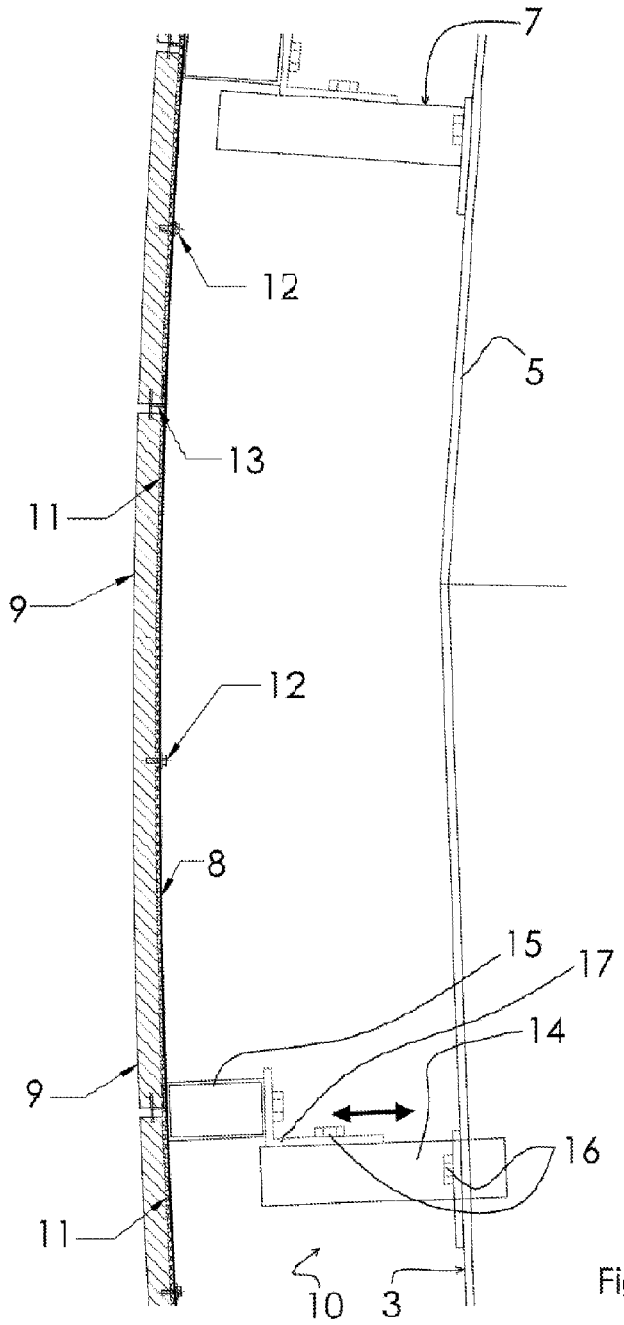
FIG. 5 is a sectional view of a part of a ventilated façade made by the method and structure according to the present invention.

FIG. 5 is a sectional view of the completed ventilated façade, with the covering slabs 9 permanently fastened to the panels 8 previously applied.

Reference number 12 denotes mechanical anchors made of stainless steel, in particular expansion bolts passing through the panels 8. In the example shown, the bolts 12 are assisted by brackets 13 screwed or welded to the panels 8 and provided with portions that can be inserted in suitable seats formed at the edges of the covering slabs 9. As an alternative to the plugs 12, rivets or other equivalent means can be used.

If necessary, an adhesive layer 11 is provided between the panels 8 and the covering slabs 9 during application.

Exploring the fastening elements 7 in detail, each comprises a spacer 14 and an element 15 which can be constrained to the spacer so as to be movable and orientable. In particular, the spacer 14 is substantially a metal section fastened to the framework 3, or directly to the wall 1 if the framework 3 is not provided, so as to cantileverly protrudes outwards. In the example shown in figures, the spacer 14 is screwed to an upright 5. The orientable element 15 is a metal section too which can be fastened, in turn, to the spacer 14 by means of a bracket 17 and screws 16.

The bracket 17 is provided with through slots, or elongated holes, which allow the passage of the screws 16 and at the same time allow the bracket 17, and therefore also the orientable element 15, to be translated and oriented with respect to the framework 3. In particular, the bracket 17 can be translated back and forth as indicated by the double arrow, and can be rotated in a plane orthogonal to the drawing sheet. Once the proper orientation has been identified, the screws 16 can be permanently tightened to lock the orientable element 15 in position.

In turn, the orientable element 15 can be rotated with respect to the bracket 17 (in a plane orthogonal to the sheet) before being locked in the desired position.

Considering that, during the installation, the interstice 10 remains temporarily accessible from above whenever a new panel 8 is anchored, the operator 2 can complete the tightening of the screws 16 of the fastening elements 7 even when the relative panel 8 is mounted. In this way different curvatures of the panel 8, i.e. different bent configurations, can be tested before locking the panel itself in the desired position.

Figure 6:
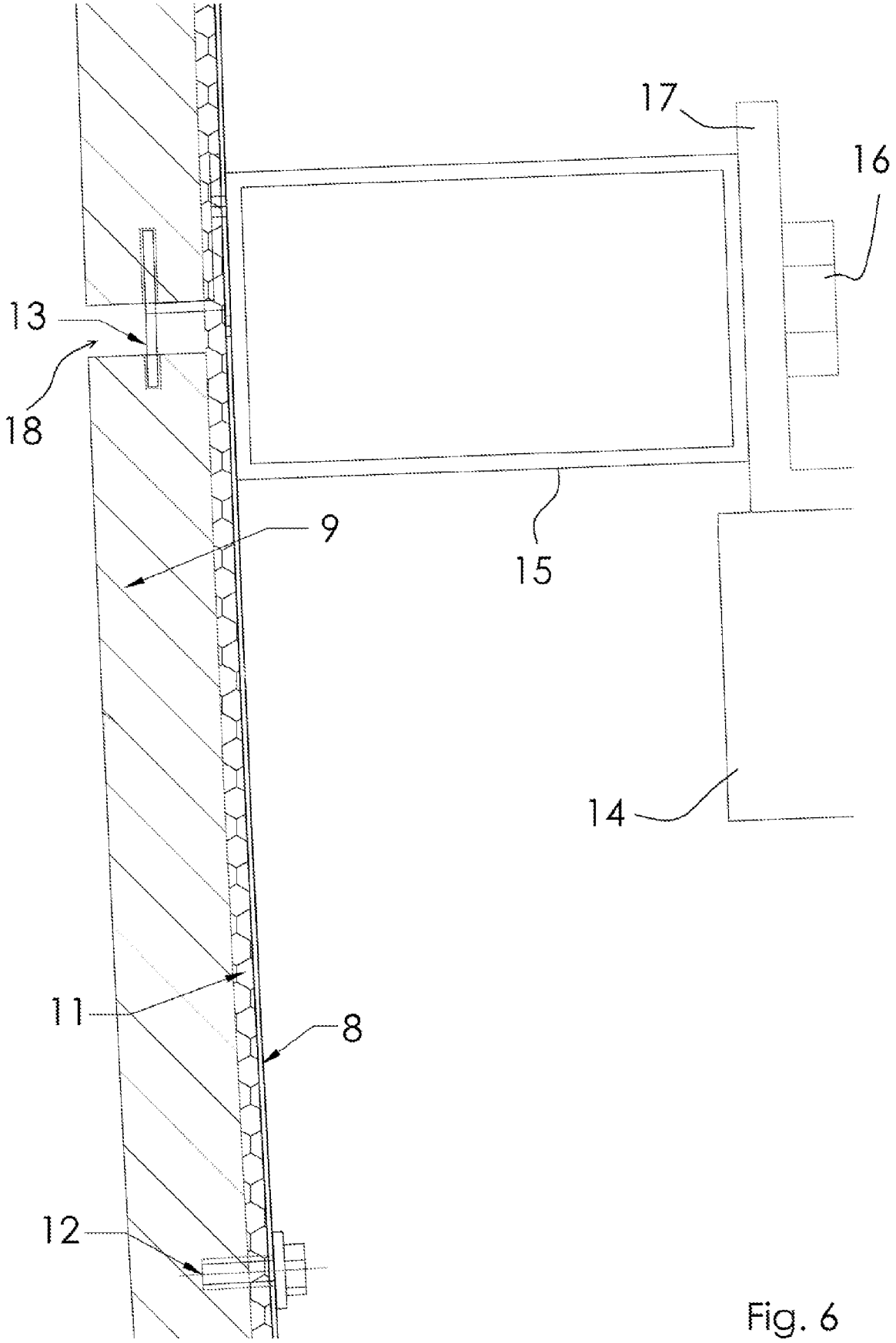
FIG. 6 is an enlargement of a detail of FIG. 5.

FIG. 6 is an enlargement of FIG. 5 showing in detail the orientable element 15 in position. In this section the mechanical anchors constraining the panels 8 to the orientable element 15 cannot be seen; there are mechanical anchors in different positions along the orientable element 15.

In the example shown in figures, the mechanical anchors 12 remain invisible to those observing the façade, because they are hidden from view. In general, however, the mechanical anchors 12, 13 can be applied on the side edge of the covering slabs 9, or on the visible side of the covering slabs 9, in order to remain visible and possibly give an aesthetic result.

The type, number and size of the mechanical anchors 12, 13 varies according to the situation, for example depending on the desired aesthetic result, the dimensions and thicknesses of the various elements used, the permanent loads and accidental loads, the climatic conditions.

The spacing 18 between the covering slabs 9 may be filled up or left open, as shown in the examples.

Preferably, the orientable elements 15 are hollow sections, with a closed perimeter as shown in the figures; in this case they can be used to channel electric cables, corrugated cables or other auxiliary lines.

Although not shown in the figures, the panels 8 can also be painted, treated or coated with films in order to resist any water infiltration.

The invention claimed is:

1. A method for covering a curved or flat wall (1) of a building, the method comprising:

a) raising, parallel to the wall (1), a bearing surface (19) comprised of a plurality of flexible panels (8);

b) constraining the bearing surface (19) to the wall (1) by fastening elements (7), which define a matrix of anchoring points, whose orientation can be adjusted the fastening elements having an extent that is adjustable along a first direction orthogonal to the wall;

c) precisely adjusting an orientation of the bearing surface (19) from the wall (1), by selectively orienting individual fastening elements (7) to keep the bearing surface (19) flat, curved or wavy in at least one of: a horizontal direction, a vertical direction or an oblique direction, and d) fastening a cover (9) to the bearing surface (19), wherein said fastening elements comprise:

a spacer permanently fastenable to the wall and whose extent can be adjusted in a first direction, and an orientable element translatable along the spacer and rotatable with respect thereto.

2. The method according to claim 1, wherein an extent of the fastening elements (7) can be adjusted and wherein step c) is carried out by also precisely adjusting also a distance of the bearing surface (19) from the wall (1), by acting selectively on the individual fastening elements (7).

3. The method according to claim 1, wherein steps a) and b) are carried out simultaneously, as the flexible panels (8) are constrained to the wall (1), or to the wall and to one another.

4. The method according to claim 1, wherein the flexible panels (8) are curved: before step a), during step c) or both before step a) and during step c).

5. The method according to claim 4, wherein the flexible panels (8) can be curved manually.

6. The method according to claim 4, wherein the flexible panels (8) are curved before step a).

7. The method according to claim 1, wherein the fastening elements (7) define a matrix of anchoring points.

8. The method according to claim 2, wherein as the extent of the fastening elements (7) increases, a width of an interstice (10) in between the bearing surface (19) and the wall (1) increases.

9. The method according to claim 1, wherein the covered bearing surface (19) and the wall (1) together define a ventilated wall or façades having a flat, or curved or wavy cover in at least one direction.

10. The method according to claim 1, wherein the flexible panels (8) are fastened to: the fastening elements (7), to one another or to both the fastening elements and one another by: mechanical anchors (12, 13), chemical adhesives (11) or both mechanical anchors and chemical adhesives.

11. The method according to claim 1, further comprising:

raising a framework (3) fastened to the wall (1), wherein the flexible panels (8) are constrained to the framework (3) by means of the fastening elements (7) and not directly to the wall (1).

* * * * *